US006146365A

United States Patent [19]

Nguyen

[11] Patent Number: 6,146,365

[45] Date of Patent: Nov. 14, 2000

[54] HYGIENIC GLOVE TOILET PAPER

[76] Inventor: Jimmy Phong Xuan Nguyen, 25/8 Mead Drive, Chipping Norton, New South Wales, Australia, 2170

[21] Appl. No.: 09/144,012

[22] Filed: Aug. 31, 1998

[30] Foreign Application Priority Data

Sep. 5, 1997 [AU] Australia ..... PO 9029

[51] Int. Cl.[7] ..... A61M 35/00; A61F 13/15; B65D 85/66

[52] U.S. Cl. ..... 604/292; 206/390; 604/358; 604/385.01

[58] Field of Search ..... 119/169, 171; 604/385.1, 378, 358, 292; 206/815, 38, 39, 40, 390; 2/158

[56] References Cited

U.S. PATENT DOCUMENTS

| | | | |
|---|---|---|---|
| 2,782,912 | 2/1957 | Humphrey | 206/47 |
| 4,902,283 | 2/1990 | Rohko et al. | 604/290 |
| 4,959,881 | 10/1990 | Murray | 15/227 |
| 5,196,244 | 3/1993 | Beck | 428/35.2 |
| 5,864,883 | 2/1999 | Reo | 2/158 |
| 5,971,138 | 10/1999 | Soughan | 206/210 |

*Primary Examiner*—Aaron J. Lewis
*Assistant Examiner*—Carie Mager
*Attorney, Agent, or Firm*—Jacobson & Johnson

[57] ABSTRACT

There is a disposable multi-layered pad for personal hygiene and disease protection comprising a pair of overlaying envelope 1, 2 detachably joined over inner abutting surfaces 1A, 2A. One of the envelopes 2A has lateral dimensions to encase the four finger digits of the human hand and the other 1A of the envelopes is dimensioned to encase the thumb. On separation during use of the pad the envelopes can function in the manner of a glove to protect the user when grasping contaminated objects. The envelope material forming the outer layers 1B, 2B of the pad being sufficiently soft, pliant and absorbant to be suitable for wiping the rectum after a bowel movement and the envelope material forming the inner abutting layers 1A, 2A being sufficiently tough and impermeable to form a contamination and moisture barrier during grasping and wiping operations.

9 Claims, 3 Drawing Sheets

HYGIENIC GLOVE TOILET PAPER

This invention relates to devices for personal hygiene. More particularly although not exclusively it discloses a low cost disposable pad which provides a hygienic glove to protect against bacteria or virus and which may also be used in place of conventional toilet paper.

One common means of disease transmission in the community occurs through the use of public toilets. When using such facilities it is necessary at the very least to operate the toilet room or cubicle door latch, raise or lower the toilet seat and depress the flush button. These activities require a grasping action of the hand which employs most of the fingers. Although the applicant's co-pending Australian patent application P08206 discloses a sheath device for protecting the palmer aspect of the individual thumb or index finger there is nothing currently available which can function in the toilet as both a low cost disposable hand protector for grasping contaminated items and as a hygienic wiper in place of conventional toilet paper.

It is an object of this invention to ameliorate the aforementioned disadvantage and accordingly a disposable multi-layered pad for personal hygiene and disease protection is disclosed comprising a pair of overlaying envelopes detachably joined over abutting side surfaces. One of said envelopes having lateral dimensions to encase the four finger digits of the human hand and the other of said envelopes being dimensioned to encase the thumb, whereby on separation said envelopes can function in the manner of a glove to protect the user when grasping contaminated objects, the envelope material forming the outer layers of said pad being sufficiently soft, pliant and absorbant to be suitable for wiping the rectum after a bowel movement and the envelope material forming the abutting layers being sufficiently tough and impermeable to form a bacteria and moisture barrier for said grasping and wiping operations.

Preferably said device is presented for use as one of a plurality of semi-detached pads forming a dispenser roll.

Figure 1:
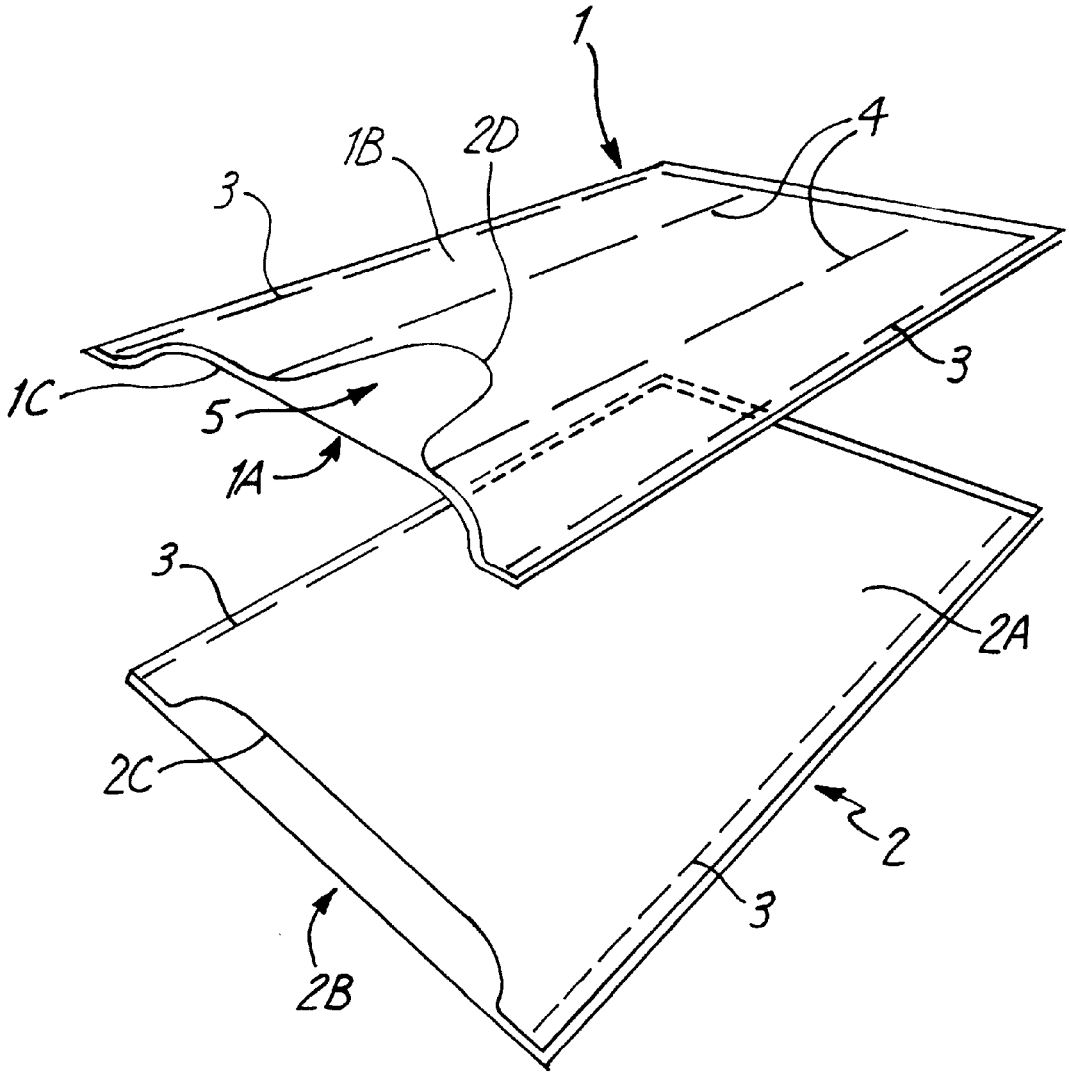
Figure 2:
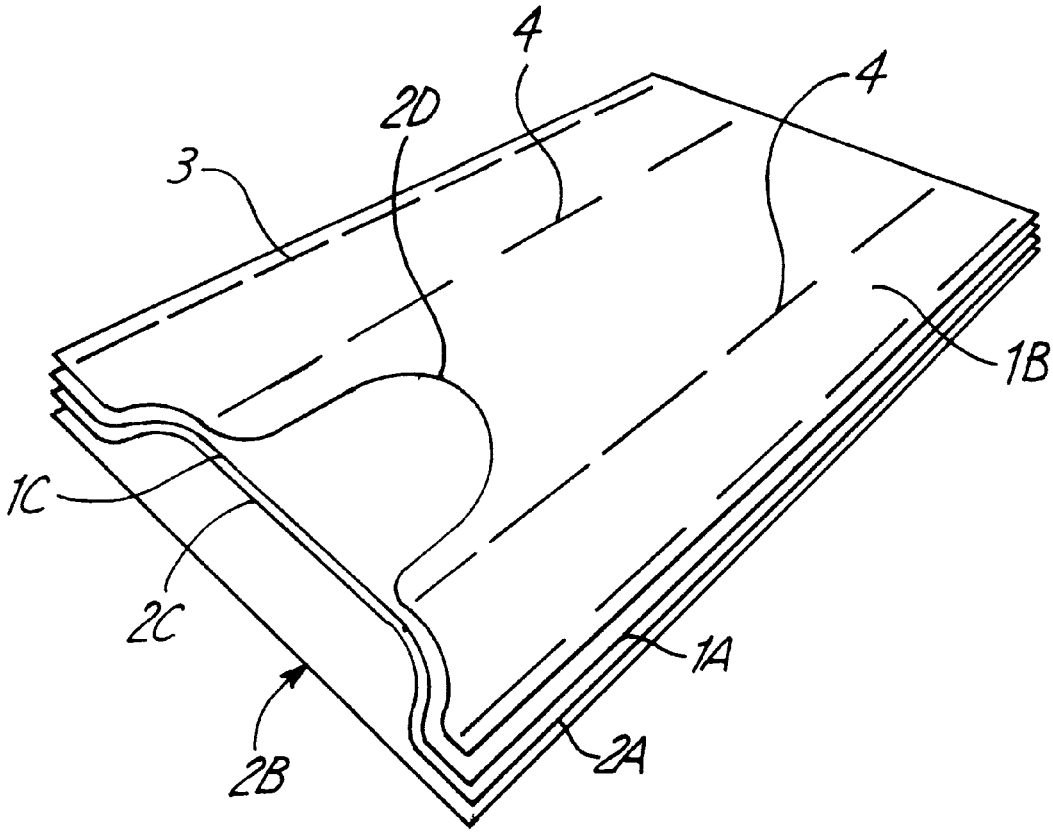
Figure 3:
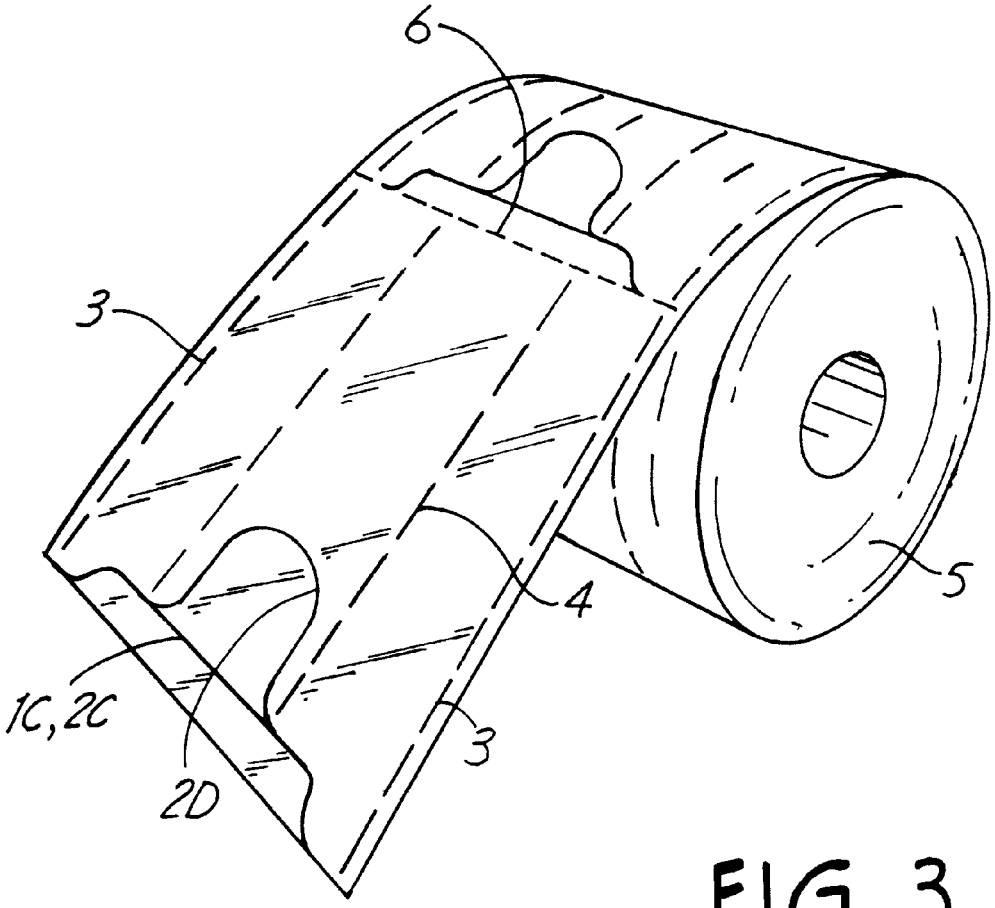

One currently preferred form of this invention will now be described with reference to the attached drawings in which:

FIG. 1 is a schematic perspective view of a disposable pad according to this concept when separated into its component envelopes, FIG. 2 shows the pad of FIG. 1 assembled, and FIG. 3 is a schematic view of a plurality of pads according to this invention in the form of dispenser roll.

Referring first to FIG. 1 the pad may comprise a pair of envelopes 1 and 2. The inner facing surfaces 1A and 2A of the envelopes are formed from sheets of relatively tough moisture resistant paper such as for example kraft paper which act as at least an effective temporary barrier against moisture, bacteria and other contamination. The outer sides 1B and 2B are preferably formed from sheets of a softer pliant and absorbant newsprint type paper similar to or the same as conventional toilet tissue. These sheets 1A, 1B and 2A, 2B are attached at their edges by glue lines 3 or any other suitable separable means such as crimping. Preferably the upper envelope 1 also has additional glue or crimping lines 4 which define a narrow central compartment 5 suitable for receiving a user's thumb. The lower envelope has wider dimensions extending substantially the full width of the sheets 2A and 2B to accomodate the remaining four finger digits of the user's hand. To assist insertion of the thumb and fingers into the respective envelopes the inner sides 1A and 2A are preferably recessed at 1C and 2C. The uppermost sheet 1B with this embodiment also has an additional cutout 2D to better accomodate the profile of the thumb.

When presented for use the envelopes would be glued, crimped or otherwise detachably joined together along the edges of their facing sides to form a flat rectangular pad as shown in FIG. 2. This pad would have soft, pliant and absorbant outer surfaces 1B and 2B suitable for use in the toilet for wiping the rectum. Between these outer surfaces double protective layers 1A and 2A of tougher paper form a barrier against moisture and bacteria. Prior to or as an alternative to use as a hygienic wiper in place of conventional toilet paper the pad may be separated into its component envelopes to function as a protective glove when for example grasping the toilet seat or closing a cubicle door.

It is further preferred that a plurality of such pads be conveniently presented for use in toilets or other contamination prone areas in the form of a dispenser roll. As shown by way of example in FIG. 3 the roll 5 could be made up of a length of such pads attached end to end along tear lines 6 with the recessed portions 1C, 2C and 2D forming the leading edges of the roll for insertion of the fingers and thumb.

It will thus be appreciated that this invention at least in the form of the embodiment disclosed provides a novel and useful improvement in personal hygiene and disease prevention devices. It is also envisaged that this product would reduce the excessive use of conventional toilet paper as the pad has a built-in moisture barrier. Clearly however the example described is only the currently preferred form of this invention and a wide variety of modifications may be made which would be apparent to a person skilled in the art. For example the materials used extend to any suitable type of low cost biodegradable paper, wet strength paper or even biodegradable plastics.

For the purposes of this specification expressions such as "upper" and "lower" refer to the pad in one particular position shown by the drawings and are not to be read as necessarily limiting.

What is claimed is:

1. A disposable multi-layered pad for personal hygiene and disease protection comprising a pair of overlaying envelopes detachably joined over inner abutting side surfaces, one of said envelopes having lateral dimensions to encase four finger digits of a human hand and the other of said envelopes being dimensioned to encase a thumb, whereby in use of said pad said envelopes can be separated to function in the manner of a glove to protect a user when grasping contaminated objects, the overlaying envelopes having outer layers and inner abutting layers, the outer layers being sufficiently soft, pliant, and absorbent to be suitable for wiping a rectum after a bowel movement and the inner abutting layers being sufficiently tough and impermeable to form a contamination and moisture barrier during grasping and wiping operations, said multi-layered pad being rectangular in shape and said pair of overlaying envelopes being detachably joined along edges thereof by glue lines or by crimping.

2. The multi-layered pad as claimed in claim 1 wherein the other of said envelopes has additional glue or crimping lines which define a narrow central compartment suitable for receiving a user's thumb.

3. The multi-layered pad as claimed in claim 2 wherein to facilitate insertion of a user's thumb and fingers into said envelopes the inner abutting layers are recessed at one end of said pad.

4. The multi-layered pad as claimed in claim 3 wherein the outer layer formed by the other of said envelopes has an additional cutout to accommodate the profile of the user's thumb.

5. The multi-layered pad as claimed in claim 4 wherein the inner abutting layers are constructed from kraft paper.

6. The multi-layered pad as claimed in claim 5 wherein the outer layers of said envelopes are made from conventional toilet tissue.

7. The multi-layered pad as claimed in claim 2 wherein the inner abutting layers of said envelopes are made from biodegradable paper.

8. The multi-layered pad as claimed in claim 4 wherein the inner abutting layers of said envelopes are from wet strength paper.

9. A plurality of disposable multi-layered pads connected together along tear lines and presented in rolled form capable of being used with a dispenser, each pad comprising a pair of overlaying envelopes detachably joined over inner abutting side surfaces, one of said envelopes have lateral dimensions to encase four finger digits of a human hand and the other of said envelopes being dimensioned to encase a thumb, whereby in use of said pad said envelopes can be separated to function in the manner of a glove to protect a user when grasping contaminated objects, the overlaying envelopes having outer layers and inner abutting layers, the outer layers being sufficiently soft, pliant, and absorbent to be suitable for wiping a rectum after a bowel movement and the inner abutting layers being sufficiently tough and impermeable to form a contamination and moisture barrier during grasping and wiping operations, said multi-layered pad being rectangular in shape and said pair of overlaying envelopes being detachably joined along edges thereof by glue liners or by crimping.

* * * * *